United States Patent [19]

Oikawa

[11] Patent Number: 4,838,721

[45] Date of Patent: Jun. 13, 1989

[54] AUTOMATIC LEAD ADVANCE FOR MECHANICAL PENCILS

[75] Inventor: Hideaki Oikawa, Kasukabe, Japan

[73] Assignee: Pentel Kabusiki Kaisha, Tokyo, Japan

[21] Appl. No.: 188,814

[22] Filed: Apr. 29, 1988

[51] Int. Cl.[4] ..... B43K 21/02; B43K 21/16

[52] U.S. Cl. ..... 401/53; 401/54; 401/55; 401/65; 401/67

[58] Field of Search ..... 401/53–58, 401/65–67, 92–94, 103, 81–84

[56] References Cited

U.S. PATENT DOCUMENTS 4,459,057 7/1984 Hashimoto et al. ..... 401/67 X 4,490,061 12/1984 Katz ..... 401/65 X

FOREIGN PATENT DOCUMENTS 58-53500 3/1983 Japan .

*Primary Examiner*—Richard J. Apley

*Assistant Examiner*—David J. Bender

*Attorney, Agent, or Firm*—Wenderoth, Lind & Ponack

[57] ABSTRACT

An automatic lead advance for a mechanical pencil having a tubular casing, a conical member joined to the front end portion of the tubular casing, a ring fixed to the inner surface of the conical member, an annular pivotable member provided at the front side of the ring, a lead guide tube having a lead retainer, urged backward by a spring, adapted to the slidable in the axial direction, and positioned so that the portion of the front end surface of the pivotable member which is away from the fulcrum of pivotal movement thereof contacts the rear end portion of the lead guide tube, a ball chuck mechanism urged forward by a knock spring and adapted to be movable between the rear end surface of the ring and an end surface of a stepped portion formed on the inner surface of the tubular casing, and a stopper provided at the front end of an outer tube of the ball chuck mechanism and contacting at the front end surface thereof the portion of the rear end surface of the pivotable member which is close to the fulcrum of pivotal movement thereof.

3 Claims, 2 Drawing Sheets

AUTOMATIC LEAD ADVANCE FOR MECHANICAL PENCILS

ACKGROUND OF THE INVENTION

The present invention relates to an automatic lead advance for mechanical pencils, which is capable of feeding a lead of a predetermined length by pressing the tip of the lead against the paper with a pressure higher than a normal writing pressure, and then releasing the lead from such a pressure.

The conventional automatic lead advances for mechanical pencils include the following automatic lead advances. In one of these automatic lead advances, a lead retainer is provided on a lead guide tube urged resiliently in the forward direction and adapted to be slidable in the axial direction. The front end of the lead guide tube or the front end of the lead which projects from the front end of the lead guide tube is pressed toward the tubular casing to thereby retract the same distance the lead and a chuck device holding the lead guide tube and lead. When the lead guide tube or the lead is then released from this pressure to return it to its original position, a time lag is provided between the starting of the returning of the lead guide tube and that of the returning of the chuck device. This enables the lead of a predetermined length to be fed.

In another conventional automatic lead advance, a lever mechanism adapted to be turned by a lead guide tube when the lead guide tube is pressed back is provided between the lead guide tube, which does not have a lead retainer, and a chuck device in which a lead is held. A lead tightening unit, which is different from the chuck device, is provided so that it is urged forward. When the lead guide tube is moved back with the lead and chuck device kept as they are, the lever mechanism is operated, and the lead tightening unit is thereby moved back by twice as long a distance as the the lead guide tube. The feeding of the lead of a predetermined length can thus be done. The latter type automatic lead advance is disclosed in Japanese Patent Application Laid-open No. 58-53500(1983).

The idea of increasing the quantity of backward movement of the lead tightening unit as compared with that of backward movement of the lead guide tube, by installing the lever mechanism in the automatic lead advance as mentioned above, in such a manner that the lead tightening unit is moved forward more than the lead guide tube when the load on the lead guide tube is removed is excellent. However, it is necessary to provide the lead tightening unit in addition to the chuck device, and, moreover, the means for urging the lead tightening unit in the forward direction. Therefore, the construction of the writing instrument as a whole becomes complicated correspondingly. Thus, the conventional automatic lead advance still needs a further improvement in this respect.

SUMMARY OF THE INVENTION

An object of the present invention is to provide an automatic lead advance capable of omitting both the above-mentioned lead tightening unit and the means for urging the lead tightening unit in the forward direction with the advantage of increasing part-displacing power of the lever mechanism still retained.

Another object of the present invention is to provide a new automatic lead advance which permits that the construction of mechanical pencil as a whole is simplified.

According to the present invention, there is provided an automatic lead advance for a mechanical pencil comprising a tubular casing, a conical member joined to the front end portion of the tubular casing, a ring fixed to the inner surface of the conical member, an annular pivotable member provided at the front side of the ring, a lead guide tube having a lead retainer, urged backward by a spring, adapted to be slidable in the axial direction, and positioned so that the portion of the front end surface of the pivotable member which is away from the fulcrum of pivotal movement thereof contacts the rear end portion of the lead guide tube, a ball chuck mechanism urged forward by a knock spring and adapted to be movable between the rear end surface of the ring and an end surface of a stepped portion formed on the inner surface of the tubular casing, and a stopper provided at the front end of an outer tube of the ball chuck mechanism and contacting at the front end surface thereof the portion of the rear end surface of the pivotable member which is close to the fulcrum of pivotal movement thereof.

DETAILED DESCRIPTION OF THE INVENTION

Figure 1:
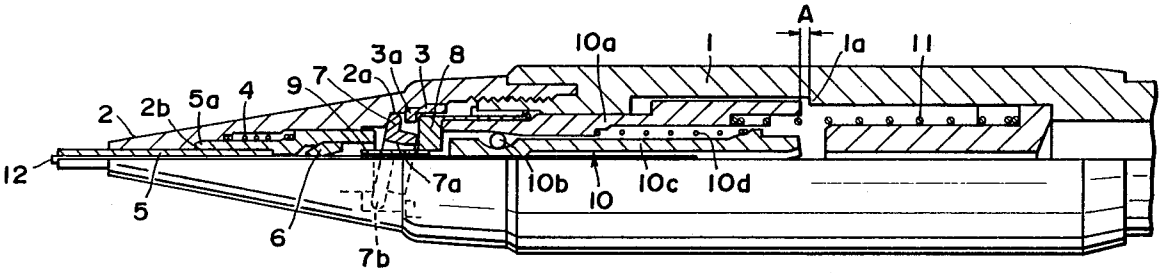
FIG. 1 is a sectional view of a principal portion of a mechanical pencil which is provided with the automatic lead advance according to the present invention, and which is in a writing operation.

A ring 3 having an annular projection 3*a* is fixed to the inner surface of a conical member 2 joined to the front end portion of a tubular casing 1. A lead guide tube 5 urged backward by a spring 4 and adapted to be slidable in the axial direction, and a pivotable member 7 contacting a part of the rear edge, or the rear end surface, of the lead guide tube 5 are provided on the inner side of such portion of the conical member 2 that is on the front side of the ring 3. A known lead retainer 6 consisting, for example, rubber is attached to the inner surface of the lead guide tube 5. The pivotable member 7 has a bore 7*a* therein the size of which is large enough to prevent the inner surface of the bore 7*a* from colliding with a lead 12 and a lead power guide tube 9, which is fixed to a stopper 8 which will be described later, when the pivotable member 7 is turned; and an annularly projecting flange 7*b* on the outer circumferential surface thereof. A recess-defining stepped portion 2*a* in which a part of the flange 7*b* of the pivotable member 7 is to be fitted is formed at that portion of the inner surface of the conical member 2 which is opposed to the front end surface of the annular projection 3*a* of the ring 3, to constitute a fulcrum of pivotal movement of the member 7. Needless to say, the parts other than this fulcrum-carrying part are formed so as not to obstruct a smooth pivotal movement of the pivotable member 7. When the pivotable member 7 is turned to a position in which the pivotable member stands substantially upright with the rear end surface of the flange 7*b* contacting the front end surface of the annular projection 3*a* of the ring 3 (refer to FIG. 3), the pivotable member 7 cannot be turned any more.

A stopper 8 is inserted slidably in that portion of the inner surface of the ring 3 which is behind the annular projection 3*a* thereof, and it is fitted slidably around the outer surface of the front end portion of an outermost tube 10*a* constituting a known ball chuck mechanism 10. This outermost tube 10*a* is urged forward by a knock spring 11. Accordingly, the stopper 8 pressed forward via the knock spring 11 and outermost tube 10*a* in the ball chuck mechanism 10 is pressed against the rear end surface of the annular projection 3*a* of the ring 3 and stops there. At this time, the front end surface of the stopper 8 contacts the surface of the pivotable member 7 which is on the side of the recess-defining stepped portion 2*a* of the conical member 2, to incline the pivotable member 7 as shown in FIG. 1. The front end surface of the pivotable member 7 thus inclined contacts the rear end of the lead guide 5 in a position which is far away from the fulcrum of a pivotal movement thereof, to press the lead guide tube 5 forward against the pressure of the spring 4. When the front end portion 5*a* of the lead guide tube 5 has then been pressed against an end surface 2*b* of a bore formed in the inner surface of the conical member 2, the lead advance as a whole is balanced and stopped, i.e., attains a steady state shown in FIG. 1.

FIG. 1 also clearly shows the relation between the outermost tube 10*a* in the ball chuck mechanism and the tubular casing 1. In the steady state mentioned above, a gap A of, for example, around 0.3–0.4 mm is formed between the rear end surface of the outermost tube 10*a* and an end surface 1*a*, which is opposed to the end surface of this tube 10*a*, of a stepped portion of the tubular casing 1. In a regular writing operation, the writing pressures of different users are different from each other but it does not occur that the outermost tube 10*a* is moved back against the force of the knock spring 11 to cause the width of the gap A to become zero. However, when a user presses the tip of a lead 12 against the paper P with a writing pressure higher than a normal writing pressure, the ball chuck mechanism 10 as a whole which holds the lead 12 firmly is moved back with the lead 12, so that the rear end surface of the outermost tube 10*a* collides with the end surface 1a of the stepped portion of the tubular casing 1. The condition of these end surfaces at this time is shown in FIG. 2.

Figure 2:
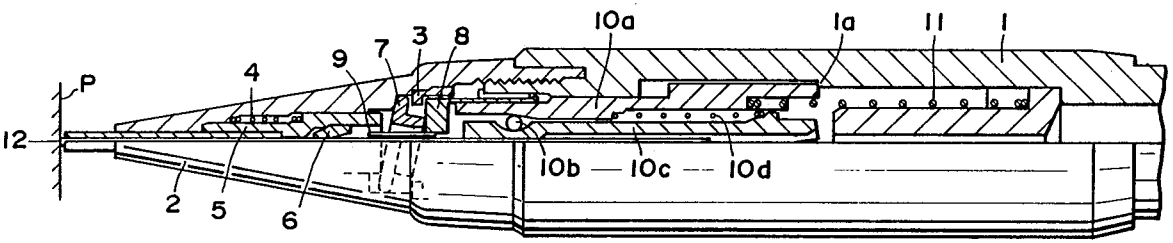
FIGS. 2–4 are sectional views showing the conditions of the lead advance according to the present invention in sequential steps of a lead feeding operation.
Figure 3:
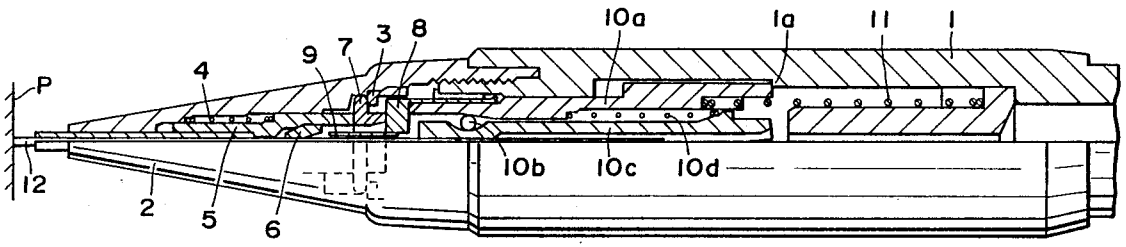
Figure 4:
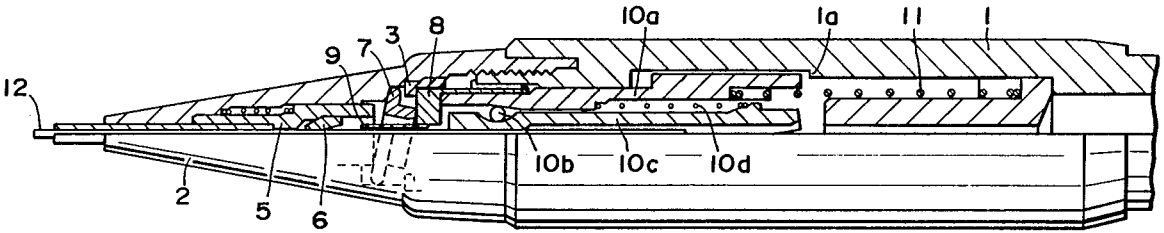

FIG. 2 shows the embodiment laying stress on the result of a backward movement of the ball chuck mechanism 10 as a whole with the conical member 2, pivotable member 7 and stopper 8 illustrated in the same positions as shown in FIG. 1, without shifting these parts to proper positions. Therefore, a gap is shown between the inner surface of the stopper 8 and the front end surface of the outermost tube 10*a*. However, in practice, when the ball chuck mechanism 10 as a whole is moved back, the lead guide tube 5 is also moved back following the chuck mechanism 10 since the lead guide tube 5 is urged backward by the spring 4. Due to the backward movement of the lead guide tube 5, the pivotable member 7 stands substantially upright to press the stopper 8 and move it back while preventing the stopper 8 from separating from the front end surface of the outermost tube 10. When the rear end surface of the outermost tube 10*a* collides with the end surface 1a of the stepped portion of the tubular casing 1, the rear end surface of the flange 7*b* of the pivotable member 7 collides with the front end surface of the annular projection 3*a* of the ring 3, so that the width of the gap A between the rear surface of the outermost tube 10*a* and the end surface 1a of the stepped portion of the tubular casing 1 becomes zero with a gap A newly occurring between the rear end surface of the ring 3 and the front end surface of the stopper 8 as shown in FIG. 3. The ball chuck mechanism 10 is moved back by a distance corresponding to the width of the gap A, while the lead guide tube 5 is moved back by a distance larger than that by which the ball chuck mechanism 10 is moved back, due to the lever ratio of the pivotable member 7. Since the lead 12 is held firmly by the ball chuck mechanism 10 during this time, the lead retainer 6 provided in the lead guide tube 5 slips on the lead 12, so that the lead guide tube 5 is moved back by a distance larger than the width of the gap A.

when the tip of the lead 12 is released from the pressing force by separating the same from the paper after the lead advance has been put in the condition shown in FIG. 3, the outermost tube is moved forward immediately due to the resilient force of the knock spring 11. Consequently, the stopper 8 is also moved forward, and stops moving forward when the front end surface of the stopper 8 collides with the rear end surface of the ring 3. The resultant condition of the lead advance is shown in FIG. 4. The forward movement of the outermost tube 10*a* causes forward movement of the lead 12 held firmly by the combination of the outermost tube 10*a*, and balls 10*b* and chuck body 10*c* which constitute the ball chuck mechanism 10. The forward movement of the stopper 8 causes the pivotable member 7, which has been in an uprightly standing state, to be turned around the fulcrum so that the pivotable member 7 is inclined again. During this time, the lead guide tube 5 is moved forward against the spring 4 by a distance larger than that by which the ball chuck mechanism 10 is moved forward, owing to the lever ratio of the pivotable member 7. Consequently, the lead 12 held by the lead retainer 6 fixed to the lead guide tube 5 is withdrawn from the ball chuck mechanism 10, and this lead-withdrawing force is transmitted to chuck spring 10d via the chuck body 10*c*. Therefore, if a spring having a small spring force is used as the chuck spring 10*d*, it is compressed easily to permit the chuck body 10*c* to move forward. The moment the chuck body 10*c* starts moving forward, the lead-clamping force of the ball chuck mechanism 10 is lost, so that the lead 12 is moved forward with the lead guide tube 5 by the lead-holding force of the lead retainer 6 without slipping.

As described above, the tip of the lead 12 is pressed forcibly against the paper to cause the lead guide tube 5 to be moved back by a distance larger than that by which the ball chuck mechanism 10 is moved back. When the tip of the lead 12 is then released from the pressing force, the lead 12 held by the lead retainer 6 is moved forward without slipping. The feeding of the lead 12 of a desired length is thus effected.

In this embodiment, the stopper 8 is fitted slidably around the outer surface of the front end portion of the outermost tube 10*a*. It may also be joined fixedly to the end surface of the outermost tube 10*a*.

What is claimed is:

1. An automatic lead advance for a mechanical pencil comprising:

a tubular casing, a conical member adapted to a front end portion of said tubular casing, a ring fixed to an inner surface of said conical member, an annular pivotable member provided at a front side of said ring so that said annular pivotable member can be turned to an inclined posture, and to a vertically standing posture when in contact with said ring, a lead guide tube having a lead retainer, said lead guide tube being urged backward by a spring, adapted to be slidable in the axial direction, and positioned so that a portion of a front end surface of said pivotable member contacts a rear end portion of said lead guide tube, a ball chuck mechanism urged forward toward said conical member by a spring and adapted to be movable between a rear end surface of said ring and an end surface of a stepped portion formed on an inner surface of said tubular casing, and a stopper provided at a front end of an outer tube of said ball chuck mechanism and contacting at a front end surface thereof a portion of a rear end surface of said pivotable member.

2. An automatic lead advance for a mechanical pencil according to claim 1, wherein said lead guide tube contacts the rear end portion of said lead guide tube at a place spaced from a fulcrum of a pivotal movement of said annular pivotable member.

3. An automatic lead advance for a mechanical pencil according to claim 1, wherein said stopper contacts the rear end surface of said pivotal member at a place close to said fulcrum of a pivotal movement of said annular pivotable member.

* * * * *